US009255462B2

(12) United States Patent
Ellis

(10) Patent No.: US 9,255,462 B2
(45) Date of Patent: Feb. 9, 2016

(54) VALVE FOR VELOCITY STRINGS

(71) Applicant: WEATHERFORD/LAMB, INC., Houston, TX (US)

(72) Inventor: Jason Ellis, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 369 days.

(21) Appl. No.: 13/622,760

(22) Filed: Sep. 19, 2012

(65) Prior Publication Data

US 2013/0075111 A1 Mar. 28, 2013

Related U.S. Application Data

(60) Provisional application No. 61/536,527, filed on Sep. 19, 2011.

(51) Int. Cl.

| | |
|---|---|
| ***E21B 34/10*** | (2006.01) |
| ***E21B 34/14*** | (2006.01) |
| ***E21B 43/12*** | (2006.01) |
| *E21B 34/00* | (2006.01) |

(52) U.S. Cl.

CPC ..... *E21B 34/10* (2013.01); *E21B 34/103* (2013.01); *E21B 34/14* (2013.01); *E21B 43/121* (2013.01); *E21B 2034/005* (2013.01)

(58) Field of Classification Search

USPC ..... 166/374, 318, 321, 332.1, 332.8, 305.1, 166/369

See application file for complete search history.

(56) References Cited

U.S. PATENT DOCUMENTS

| | | | | |
|---|---|---|---|---|
| 2002/0139539 | A1 * | 10/2002 | Hoffman et al. | 166/381 |
| 2003/0047315 | A1 * | 3/2003 | Allamon | 166/332.8 |
| 2004/0035584 | A1 * | 2/2004 | Gleim et al. | 166/369 |
| 2004/0140093 | A1 * | 7/2004 | Vloedman et al. | 166/277 |

* cited by examiner

*Primary Examiner* — Taras P Bemko

(74) *Attorney, Agent, or Firm* — Patterson & Sheridan, L.L.P.

(57) ABSTRACT

The present invention generally relates to a valve assembly for use with a velocity string. The valve assembly is used during the snub-in operation and the snub-out operation of the velocity string. In one aspect, a valve for a velocity string is provided. The valve includes a body having a bore. The valve further includes a flapper member disposed in the body, wherein the flapper member includes a flapper that is movable between an opened position in which fluid flow is allowed to move through the bore in a first direction and a second direction, and a closed position in which fluid flow through the bore is blocked in the second direction. The valve further includes a sleeve member attached to the body by a releasable connection, wherein the sleeve member is configured to hold the flapper member in the opened position. The sleeve member is movable through the bore of the body upon release of the releasable connection. In another aspect, a method of using a valve attached to a bottom of a velocity string is provided. In a further aspect, a valve assembly for use with a velocity string is provided.

24 Claims, 6 Drawing Sheets

VALVE FOR VELOCITY STRINGS

CROSS-REFERENCE TO RELATED APPLICATIONS

This application claims benefit of U.S. provisional patent application Ser. No. 61/536,527, filed Sep. 19, 2011, which is herein incorporated by reference in its entirety.

BACKGROUND OF THE INVENTION

1. Field of the Invention

Embodiments of the present invention generally relate to well production. More particularly, the invention relates to a valve for a velocity string.

2. Description of the Related Art

Wells typically include casing and production tubing. The casing is used to prevent the wellbore from collapsing, and the production tubing is used to convey wellbore fluid, such as natural gas or petroleum, to the surface of the well. The production tubing is suspended within the casing by a collar that connects the top of the production tubing to the top of the casing.

Over the life-span of the well, a gradual reduction in well pressure causes a corresponding reduction in the exit velocity of the wellbore fluid from the well through the production tubing. After the exit velocity drops below an acceptable level, production from the well is boosted by inserting a coil tubing velocity string within the production tubing. The coil tubing velocity string has a smaller diameter than a diameter of the production tubing and thus the coil tubing velocity string has a smaller fluid flow area. The smaller fluid flow area in the coil tubing velocity string will result in an increased fluid flow velocity.

Typically, the coil tubing velocity string is deployed into the live well with an end plugged for pressure control. After producing wellbore fluid through the coil tubing velocity string, it may be necessary to pull out the coil tubing velocity string from the production tubing. However, the well must be killed or a micro-type bridge plug must be set in the coil tubing velocity string to control the pressure prior to pulling the coil tubing velocity string from the production tubing. These pressure control techniques can be expensive or may cause damage to the well. Therefore, there is a need for a device that can be used with the coil tubing velocity string for pressure control that is cost-effective and minimizes damage to the well.

SUMMARY OF THE INVENTION

The present invention generally relates to a valve assembly for use with a velocity string. The valve assembly is used during the snub-in operation and the snub-out operation of the velocity string. In one aspect, a valve for a velocity string is provided. The valve includes a body having a bore. The valve further includes a flapper member disposed in the body, wherein the flapper member includes a flapper that is movable between an opened position in which fluid flow is allowed to move through the bore in a first direction and a second direction, and a closed position in which fluid flow through the bore is blocked in the second direction. The valve assembly further includes a sleeve member attached to the body by a releasable connection, wherein the sleeve member is configured to hold the flapper member in the opened position. The sleeve member is movable through the bore of the body upon release of the releasable connection.

In another aspect, a method of using a valve attached to a bottom of a velocity string is provided. The method includes the step of blocking fluid flow through the velocity string in a first direction and a second direction as the velocity string is being positioned in a production tubing. The method further includes the step of unblocking fluid flow through the velocity string in both directions by selectively removing a plug member attached to a body of the valve. Additionally, the method includes the step of blocking fluid flow through the velocity string in the second direction by closing a flapper in the valve in response to movement of a sleeve member through the body of the valve.

In a further aspect, a valve assembly for use with a velocity string is provided. The valve assembly includes a valve having a flapper that is movable between an opened position and a closed position in response to the movement of a sleeve member through a body of the valve. The valve assembly further includes a plug disposed within a plug housing that is operatively attached to the valve, wherein the plug housing has a bore in fluid communication with a bore of the valve.

In a further aspect, a method of using a velocity string in a well is provided. The method includes the step of attaching a valve assembly to an end of the velocity string, wherein the valve assembly includes a plug and a flapper member. The method further includes the step of lowering the velocity string and valve assembly into a production tubing in a well. Additionally, the method includes the step of removing the plug from the valve assembly and conveying wellbore fluid through the velocity string to the surface of the well.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

The present invention generally relates to a valve assembly for use with a coiled tubing velocity string. The valve assembly is used during the snub-in operation and the snub-out operation of the coiled tubing velocity string. The valve assembly will be described herein in relation to a coiled tubing velocity string. It is to be understood, however, that the valve assembly may also be used with other types of tubulars or velocity strings without departing from principles of the present invention. To better understand the novelty of the valve assembly of the present invention and the methods of use thereof, reference is hereafter made to the accompanying drawings.

Figures 1, 2, 3, 4:
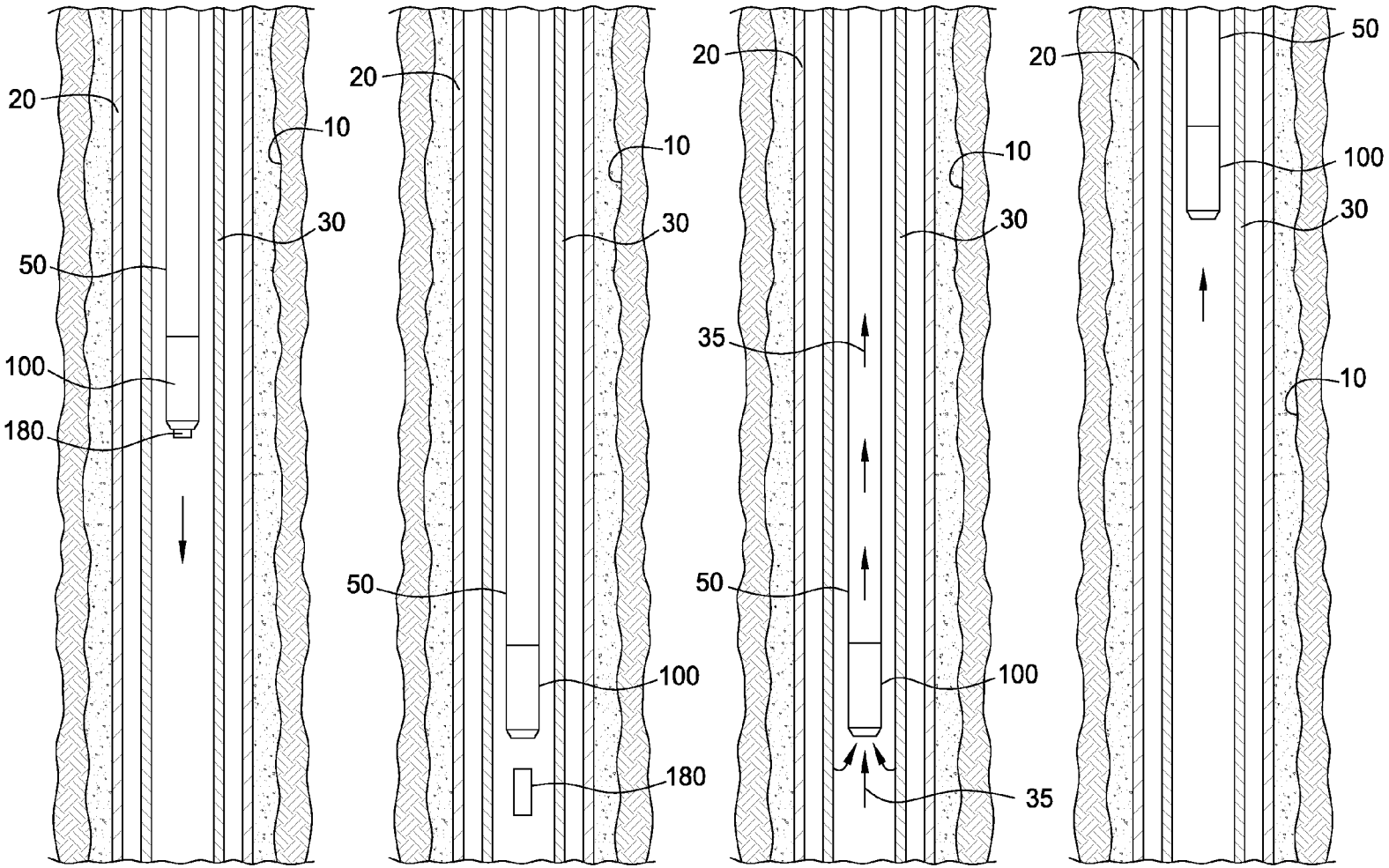
FIG. 1 illustrates a view of a velocity string with a valve assembly being lowered into a wellbore during a snub-in operation.
FIG. 2 illustrates a view of the velocity string after a plug has been released in the valve assembly.
FIG. 3 illustrates a view of the velocity string during a production operation.
FIG. 4 illustrates a view of the velocity string with the valve assembly being removed from the wellbore during a snub-out operation.

FIG. 1 illustrates a view of a velocity string 50 with a valve assembly 100 being lowered into a wellbore 10 during a snub-in operation. The valve assembly 100 is attached to an end of the velocity string 50 to control the fluid flow through the velocity string 50 during the snub-in operation and the snub-out operation. Generally, the valve assembly 100 includes a valve portion and a plug portion.

The velocity string 50 is a small-diameter tubing string that is run inside a production tubing 30 as a remedial treatment to resolve liquid-loading problems. During production of the well, the production tubing 30 is disposed within a casing 20 to transport wellbore fluid to the surface of the well. The reservoir pressure in the wellbore 10 may deplete during the production cycle, and there may be insufficient velocity to transport all liquids from the wellbore 10 by using the production tubing 30. Over time, the liquids accumulate in the wellbore 10 and impair production of wellbore fluid. By installing the velocity string 50 which has a smaller diameter than the production tubing 30, the flow area is reduced, and the flow velocity is increased to enable liquids to be carried from the wellbore 10. One common type of velocity string is coiled tubing because rapid mobilization enables coiled tubing velocity strings to provide a cost-effective solution to liquid loading in gas wells.

Figure 1A:
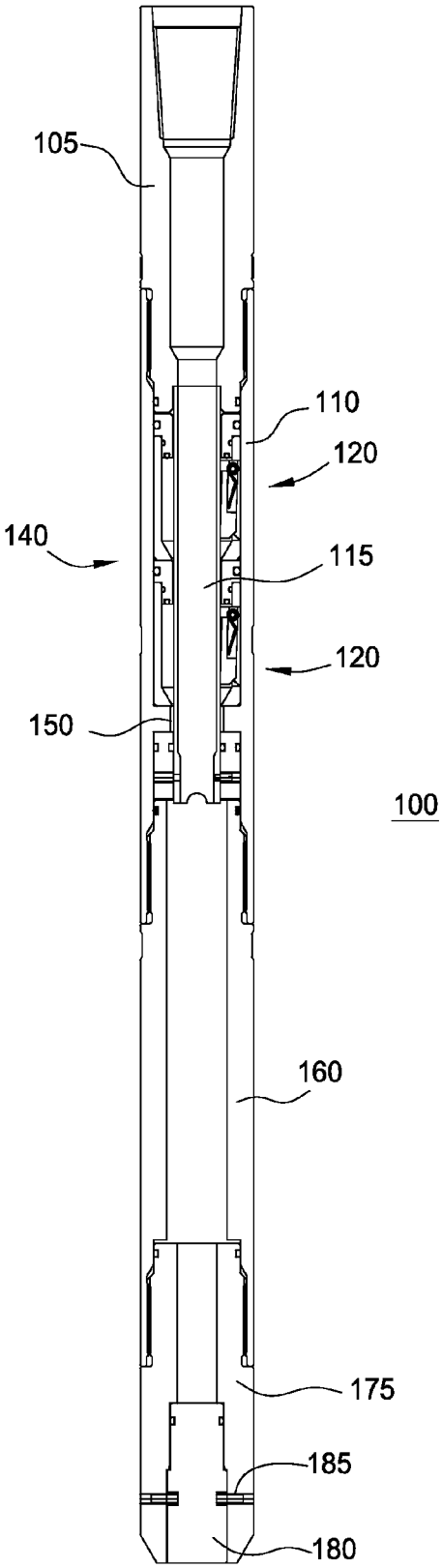
FIGS. 1A and 1B illustrate views of the valve assembly with flapper members in an opened position.
Figure 1B:
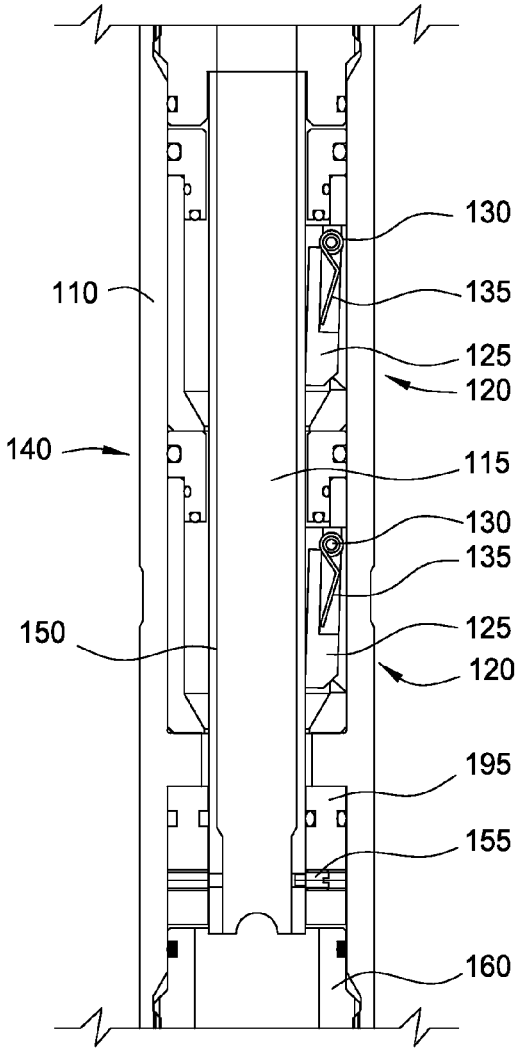

FIGS. 1A and 1B are enlarged view of the valve assembly 100 in a run-in position. The valve assembly 100 includes a connection mandrel 105 for connecting the valve assembly 100 to an end of the velocity string 50 (see FIG. 1). The connection mandrel 105 is connected to a valve 140. The valve includes a body 110. The body 110 is disposed around first and second flapper members 120.

Each flapper member 120 in the valve 140 includes a flapper 125 that is rotationally attached via a pin 130 to a flapper mount. Each flapper member 120 is movable between an opened position and a closed position. Each flapper member 120 is biased in the closed position by a biasing member 135. As will be described herein, the plug 180 blocks fluid flow though the bore 115 of the valve assembly 100 during the snub-in operation and the flapper members 120 of the valve 140 are configured to close off a bore 115 of the valve assembly 100 during the snub-out operation. In another embodiment, the flapper members 120 may be used in place of the plug 180. In this embodiment, the flapper members 120 are configured to be in the closed position during the snub-in operation to block fluid flow though the bore 115 of the valve assembly 100, move to the opened position for the production operation, and return to the closed position during the snub-out operation to close off the bore 115 of the valve assembly 100.

The flapper 125 pivots from the opened position (FIG. 1A) to the closed position (FIG. 4C) in response to movement of a sleeve member 150. In the opened position, a fluid pathway is created through the bore 115 of the body 110, thereby allowing the flow of fluid through the valve 140. In the closed position, the flapper 125 blocks the fluid pathway through the bore 115, thereby preventing the flow of fluid through the valve 140 in one direction. Although the valve 140 in FIG. 1A shows two flapper members, the valve 140 may have one flapper member or any number of flapper members without departing from principles of the present invention. As shown in FIG. 1A, an annular body 195 is attached to the body 110. The sleeve member 150 is attached to the annular body 195 via a releasable connection 155, such as a shear pin.

The body 110 is attached to a sleeve member receptacle 160. The sleeve member receptacle 160 is configured to receive the sleeve member 150 as described herein. The sleeve member receptacle 160 is attached to a plug housing 175 at a lower end of the valve 140. A plug 180 is attached to the plug housing 175 by a releasable connection 185, such as a shear pin. The plug 180 blocks fluid flow though the bore 115 of the valve assembly 100 during the snub-in operation.

FIG. 2 illustrates a view of the velocity string 50 after the plug 180 has been released in the valve assembly 100. After the velocity string 50 and the valve assembly 100 are deployed and positioned within the production tubing, fluid is pumped into the velocity string 50 from the surface to create a fluid pressure in the valve assembly 100, which is used to release the plug 180 from the valve assembly 100.

Figure 2A:
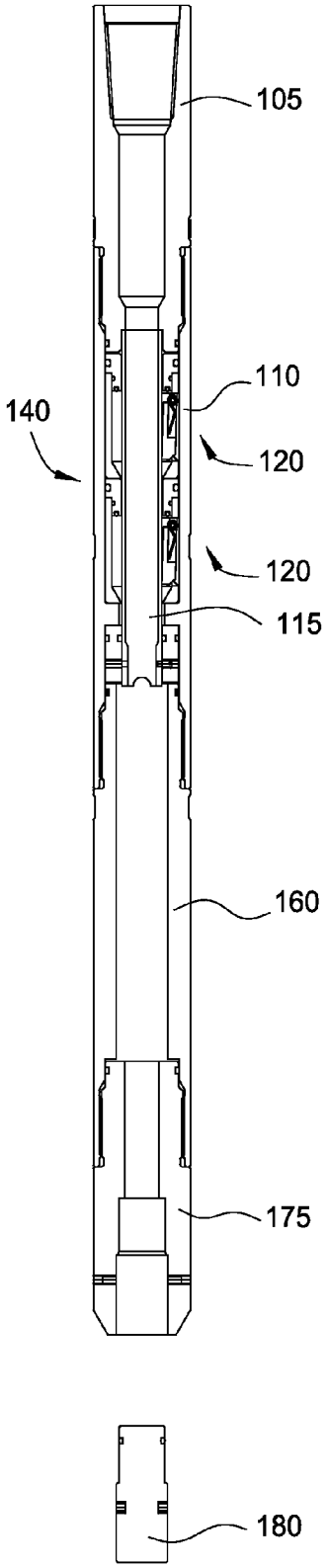
FIGS. 2A and 2B illustrate views of the plug and a plug housing of the valve assembly.
Figure 2B:
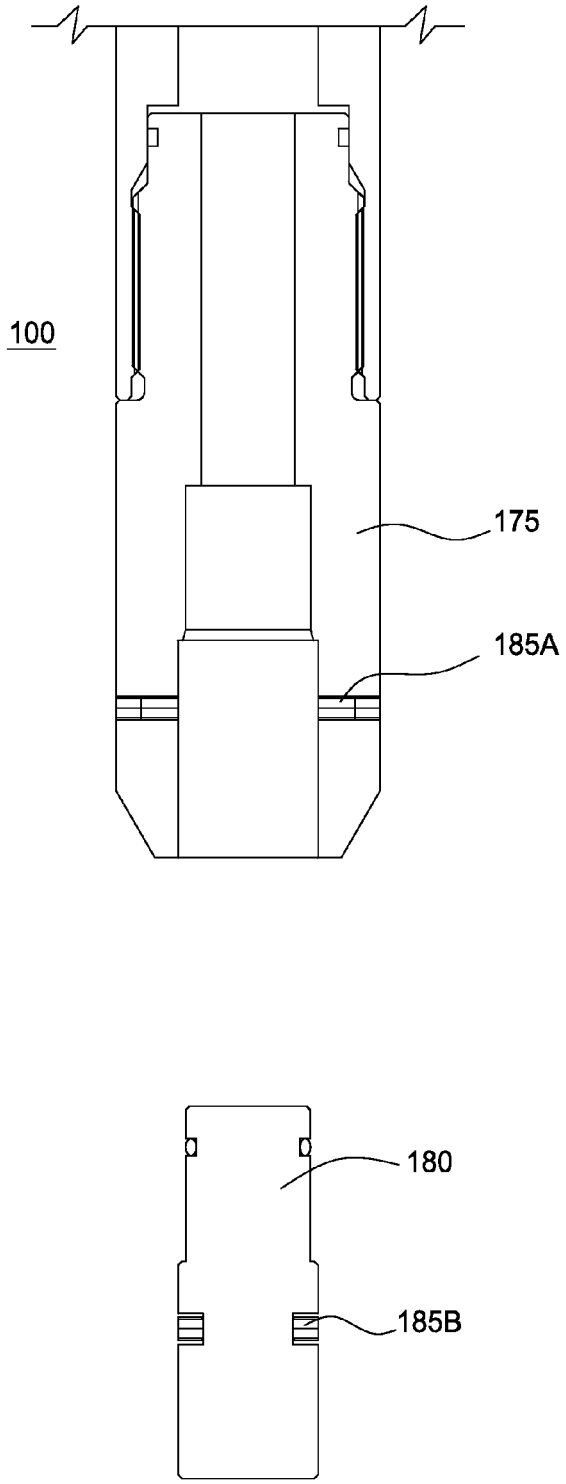

FIGS. 2 and 2A illustrate views of the valve assembly 100 after the plug 180 is released from the plug housing 175. As set forth herein, fluid is pumped into the velocity string 50 from the surface to create a fluid pressure in the valve assembly 100. At a predetermined fluid pressure, the releasable connection 185 between the plug 180 and the plug housing 175 is released, thereby allowing the plug 180 to move relative to the plug housing 175. As shown in FIG. 2A, the plug 180 has been expelled from the plug housing 175, and the releasable connection 185 has been separated into a first portion 185A and a second portion 185B. At this point, the bore 115 of the valve assembly 100 is opened.

Figure 3A:
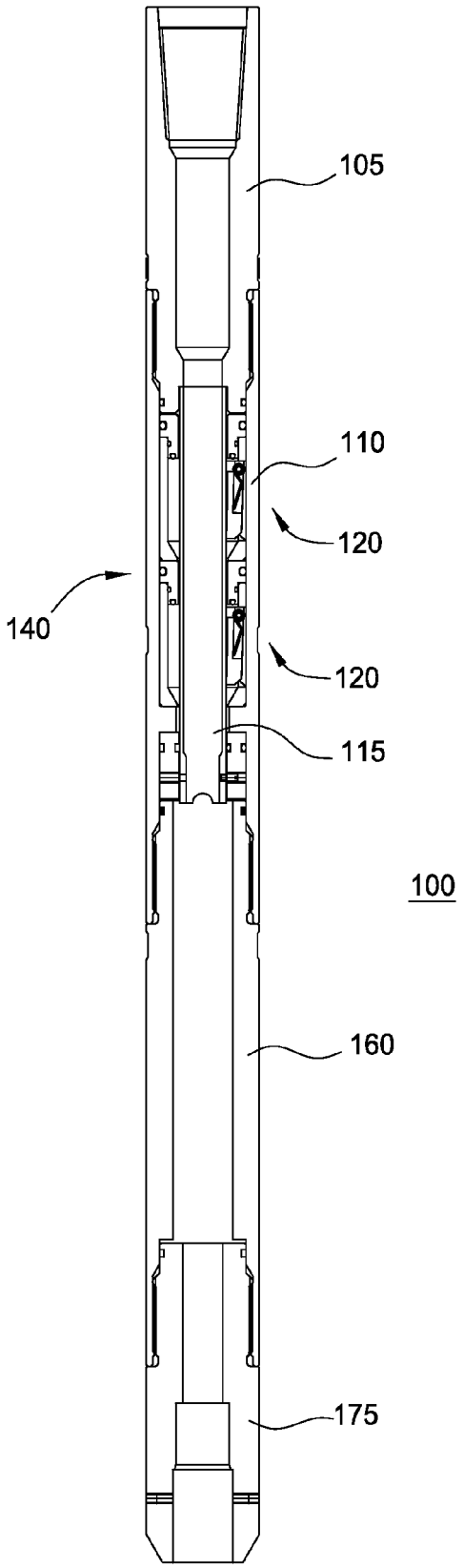
FIG. 3A illustrates a view of the valve assembly in an opened position.

FIG. 3 illustrates a view of the velocity string 50 during a production operation. After the plug 180 has been removed from the valve assembly 100, the valve assembly 100 allows wellbore fluid 35 to move through the valve assembly 100 and into the velocity string 50. The valve assembly 100 typically remains in this configuration during the production operation. FIG. 3A illustrates a view of the valve assembly 100 in the opened position.

FIG. 4 illustrates a view of the velocity string 50 with the valve assembly 100 being removed from the wellbore 10 during a snub-out operation. Prior to the removal of the velocity string 50 and valve assembly 100, the valve assembly 100 is closed as will be described herein.

Figure 4A:
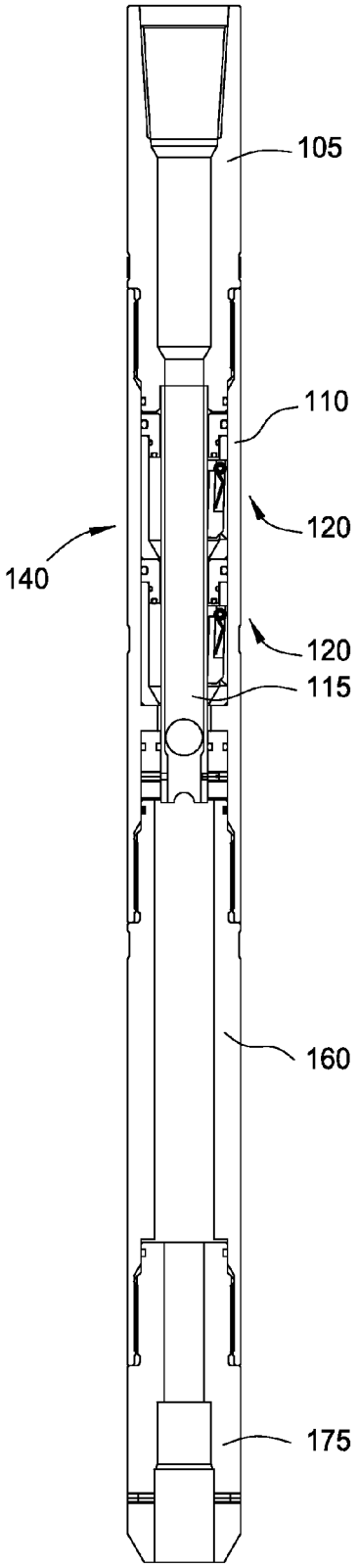
FIGS. 4A and 4B illustrate views of the valve assembly after a fluid-blocking member is disposed in a sleeve member.
Figure 4B:
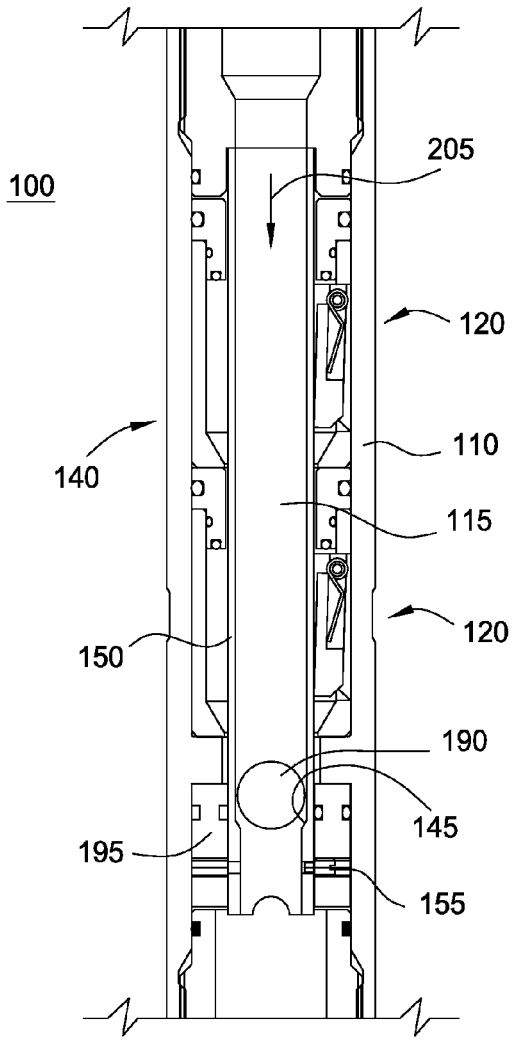

FIGS. 4A and 4B illustrate views of the valve assembly 100 after a fluid-blocking member 190 is disposed in the sleeve member 150. Prior to the snub-out operation, the fluid-blocking member 190 is dropped or pumped through the velocity string 50 from the surface of the well. The fluid-blocking member 190 may be a ball, a dart, or any other fluid-blocking member. The fluid-blocking member 190 moves through the bore 115 of the valve assembly 100 until it lands in a seat 145 in the sleeve member 150 (FIG. 4B). After the fluid-blocking member 190 is positioned in the seat 145, fluid flow through the bore 115 of the valve assembly 100 is blocked in a first direction, which is indicated by arrow 205. Thereafter, fluid is pumped into the velocity string 50 from the surface to create a fluid pressure in the bore 115 of the valve assembly 100. At a predetermined fluid pressure, the releasable connection 155 between the sleeve member 150 and the annular body 195 is released, thereby allowing the sleeve member 150 to move relative to the body 110.

Figure 4C:
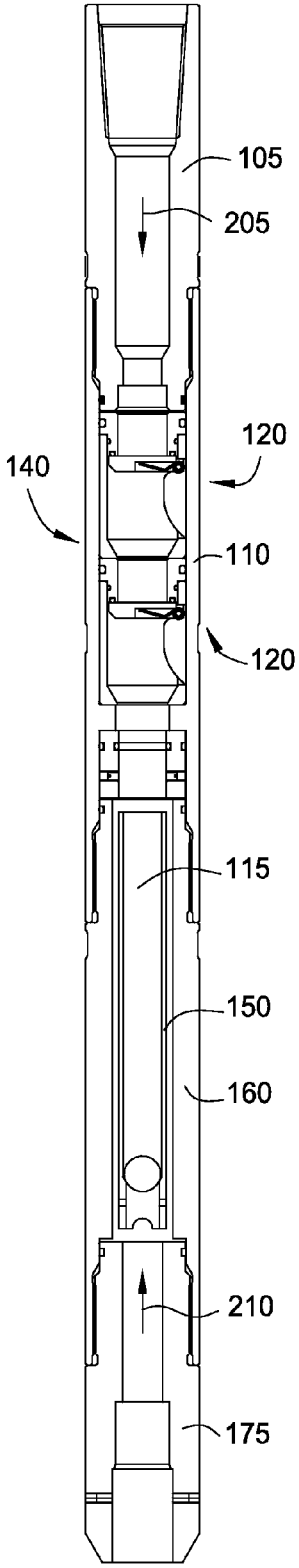
FIGS. 4C, 4D and 4E illustrate views of the valve assembly with flapper members in a closed position.
Figure 4D:
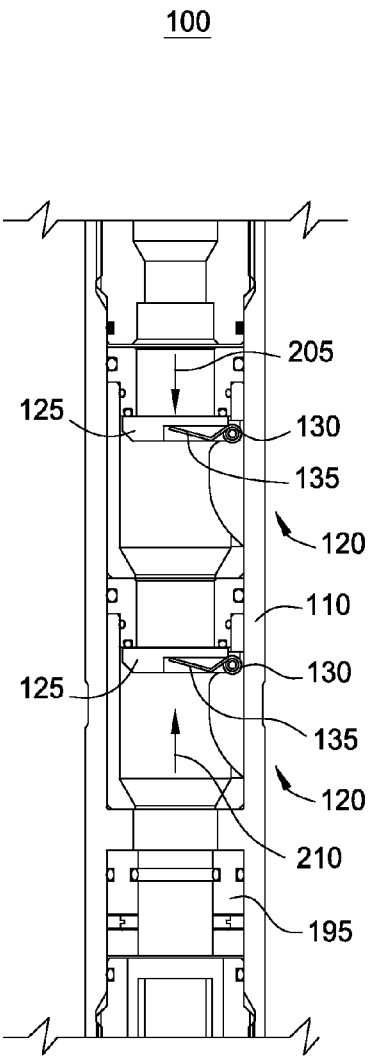
Figure 4E:
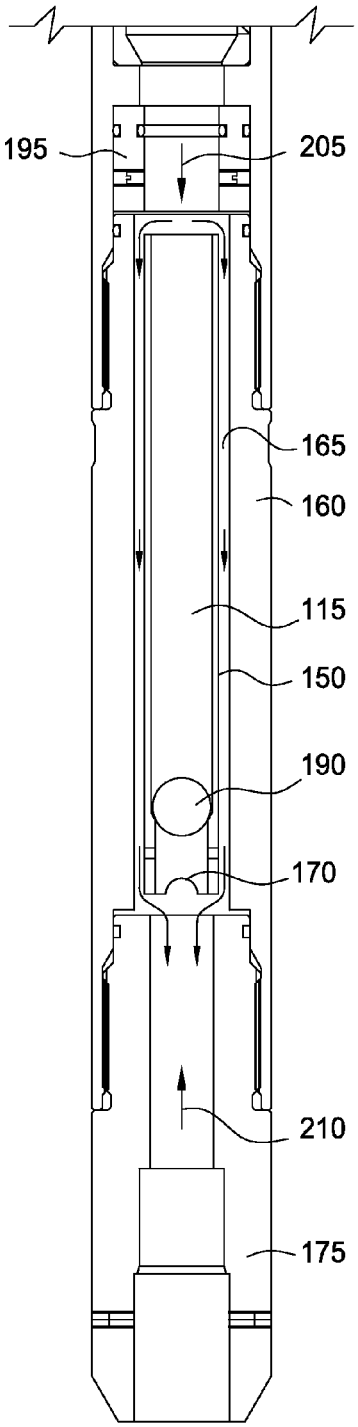

FIGS. 4C, 4D and 4E illustrate views of the valve assembly 100 after the sleeve member 150 is moved into the sleeve member receptacle 160. After the releasable connection 155 has been released, the sleeve member 150 moves into the sleeve member receptacle 160 (FIG. 4C) and lands on a shoulder formed on an upper end of the plug housing 175.

As the sleeve member 150 moves relative to body 110 past each flapper member 120, the biasing member 135 in the respective flapper member 120 causes the flapper 125 to rotate around the pin 130 until the flapper 125 engages a flapper seat in the flapper mount. At that point, the flapper members 120 are in the closed position (FIG. 4D). Thus, fluid flow in the bore 115 is blocked in a second direction, represented by arrow 210. The valve assembly 100 in the configuration shown in FIG. 4E allows the velocity string to be removed from the production tubing in a snub-out operation without allowing wellbore fluid to move through the bore 115 of the valve assembly 100 (and velocity string) in the second direction, arrow 210. In other words, the flapper members 120 hold back well pressure. In this manner, the velocity string (and the valve assembly 100) may be removed from the wellbore without having to kill the well or deploy a micro-type bridge plug to control the pressure, as in the conventional means during a snub-out operation of a velocity string.

Fluid flow is blocked in the second direction, arrow 210, while at the same time fluid flow may flow in the first direction, represented by arrow 205, as long as the fluid flow in the first direction is able to cause the flapper 125 to rotate around the pin 130 toward the opened position. In this manner, wellbore fluid is blocked from moving through the bore 115 in the second direction (arrow 210), while at the same time fluid may be pumped through the bore 115 in the first direction (arrow 205). As shown in FIG. 4E, fluid flow in the first direction (arrow 205) moves through the bore 115 and bypasses the fluid-blocking member 190 by going through an annulus 165 formed between the sleeve member 150 and the sleeve member receptacle 160. In one embodiment, the sleeve member 150 may have optional cutouts 170 at an end of the sleeve member 150 to allow fluid flow to pass through the contact area of the sleeve member 150 and the plug housing 175.

In operation, the valve assembly 100 is attached to an end of the velocity string 50. The velocity string 50 with the valve assembly 100 is run into the wellbore and positioned within a production tubing. As set forth herein, wells typically include casing and production tubing. The casing is used to prevent the wellbore from collapsing, and the production tubing is used to convey wellbore fluid to the surface of the well. After the velocity string 50 with the valve assembly 100 is run into the wellbore, the velocity string 50 is suspended in the wellbore. Thereafter, the plug 180 is removed from the valve assembly 100. At this point, wellbore fluid is allowed to flow though the valve assembly 100 and the velocity string 50. In this manner, the velocity string 50 is used to convey wellbore fluid to the surface of the well rather than the production tubing. When it is desired to remove the velocity string 50 from the wellbore, the fluid-blocking member 190 is dropped or pumped through the velocity string 50 from the surface of the well until it lands in a seat 145 of the sleeve member 150. Thereafter, fluid is pumped into the velocity string 50 from the surface to create a fluid pressure in the bore 115 of the valve assembly 100. At a predetermined fluid pressure, the releasable connection 155 between the sleeve member 150 and the annular body 195 is released, thereby allowing the sleeve member 150 to move relative to the body 110. As the sleeve member 150 moves past each flapper member 120, the biasing member 135 in the respective flapper member 120 causes the flapper 125 to rotate around the pin 130 until the flapper 125 engages a flapper seat in the flapper mount. At that point, the flapper members 120 are in the closed position. Thus, wellbore fluid can no longer flow through the velocity string 50 and the valve assembly 100. However, fluid may still be pumped from the surface through the velocity string 50 and the valve assembly because the flapper members 120 are one-way valves which block fluid flow in one direction. Optionally, pumping fluid down the velocity string 50 and through the valve assembly 100 may be useful to ensure that there is no gas trapped under the flapper members 120. After the flapper members 120 are in the closed position, the velocity string 50 and the valve assembly 100 may be removed from the wellbore.

As shown in FIGS. 1-4, the valve assembly 100 includes the sleeve member receptacle 160 to receive the sleeve member 150, after the sleeve member 150 is released from the body 110. In another embodiment, the plug housing is attached directly to the valve body without the sleeve member receptacle therebetween. After the sleeve member is released from the valve body as set forth herein, the sleeve member moves through the plug housing and out of the valve assembly 100 to a location below the valve assembly 100.

While the foregoing is directed to embodiments of the present invention, other and further embodiments of the invention may be devised without departing from the basic scope thereof, and the scope thereof is determined by the claims that follow.

The invention claimed is:

1. A valve for a velocity string, the valve comprising:

a body having a bore;

a flapper member disposed in the body, the flapper member having a flapper that is movable between an opened position in which fluid flow is allowed to move through the bore in a first direction and a second direction and a closed position in which fluid flow through the bore is blocked in the second direction; and a sleeve member attached to the body by a releasable connection, wherein the sleeve member has a first location within the body to hold the flapper member in the opened position, and a second location within the body to allow the flapper member to move to the closed position, the sleeve member is movable within the bore of the body from the first location to the second location upon release of the releasable connection; a sleeve member receptacle for receiving the sleeve member at the second location; and a plug member that is operatively attached to the body by a releasable member, wherein the plug member is removable from the body.

2. The valve of claim 1, wherein the flapper member moves to the closed position in response to the movement of the sleeve member.

3. The valve of claim 1, wherein the sleeve member includes a seat for receiving a fluid-blocking member.

4. The valve of claim 3, wherein the fluid-blocking member is configured to block the flow of fluid through the bore of the body in the first direction until the sleeve member moves from the first location to the second location.

5. The valve of claim 1, wherein the flapper rotates around a pin member as the flapper moves between the opened position and the closed position.

6. The valve of claim 5, wherein the flapper is biased in the closed position by a biasing member.

7. The valve of claim 1, further comprising a connection mandrel for connecting the valve to an end of the velocity string.

8. The valve of claim 1, wherein the sleeve member includes cutouts at an end thereof to allow fluid flow in the first direction.

9. A method of using a valve attached to a bottom of a velocity string, the valve having a body, a flapper, a sleeve member, a sleeve member receptacle, and a plug member, the method comprising:

blocking fluid flow through the velocity string in a first direction and a second direction as the velocity string is with the plug member being positioned in a production tubing;

unblocking fluid flow through the velocity string in both directions by selectively removing the plug member from the body of the valve; and blocking fluid flow through the velocity string in the second direction by closing the flapper in the valve in response to movement of the sleeve member from the body to the sleeve member receptacle.

10. The method of claim 9, wherein the sleeve member is attached to the body of the valve by a releasable connection.

11. The method of claim 10, further comprising pumping a fluid-blocking member through the velocity string until the fluid-blocking member contacts a seat in the sleeve member.

12. The method of claim 11, further comprising pumping fluid through the velocity string to generate a fluid pressure in the valve that acts on the fluid-blocking member.

13. The method of claim 12, further comprising applying a predetermined fluid pressure on the fluid-blocking member to cause the releasable connection to release the connection between the sleeve member and the body, and allow the sleeve member to move relative to the body.

14. The method of claim 9, further comprising receiving the sleeve member in a sleeve member receptacle as the sleeve member moves within the body of the valve.

15. A valve assembly for use with a velocity string, the velocity string being disposable within a production tubing, the assembly comprising:

a valve having a flapper that is movable between an opened position and a closed position in response to the movement of a sleeve member within a body of the valve, wherein the sleeve member has a first location within the body to hold the flapper in the opened position and a second location within a sleeve member receptacle to allow the flapper to move to the closed position; and a plug releasably attached to a plug housing that is operatively attached to the valve, wherein the plug housing has a bore in fluid communication with a bore of the valve.

16. The valve assembly of claim 15, wherein the sleeve member is attached to the body of the valve by a releasable connection.

17. The valve assembly of claim 16, wherein the sleeve member is allowed to move relative to the body upon release of the connection between the sleeve member and the body.

18. The valve assembly of claim 16, wherein the flapper blocks flow through the bore of the valve in one direction when the flapper is in the closed position.

19. The valve assembly of claim 18, wherein the plug is releasable from the plug housing upon application of a predetermined fluid pressure within the bore of the valve.

20. A method of using a velocity string in a well, the method comprising:

attaching a valve assembly to an end of the velocity string, the valve assembly having a plug, a flapper member, and a sleeve member having a first position in a body to keep the flapper in an opened position and a second position in a sleeve member receptacle to allow the flapper member in a closed position;

lowering the velocity string and valve assembly into a production tubing in the well while blocking fluid flow through the velocity string with the plug; and removing the plug from the valve assembly to permit the flow through the velocity string; and conveying wellbore fluid through the velocity string to the surface of the well.

21. The method of claim 20, further comprising activating the flapper member which causes the velocity string to be closed to fluid flow in a first direction.

22. The method of claim 21, further comprising removing the velocity string and valve assembly from the well.

23. The method of claim 21, further comprising pumping fluid through the velocity string and the valve assembly in a second direction.

24. The method of claim 20, wherein the velocity string comprises a coiled tubing.

* * * * *

UNITED STATES PATENT AND TRADEMARK OFFICE

CERTIFICATE OF CORRECTION

PATENT NO. : 9,255,462 B2
APPLICATION NO. : 13/622760
DATED : February 9, 2016
INVENTOR(S) : Jason Ellis It is certified that error appears in the above-identified patent and that said Letters Patent is hereby corrected as shown below:

In the Claims:

Column 7, Claim 9, Line 6, please insert -- with the plug member -- before as;

Column 7, Claim 9, Line 7, please delete "with the plug member".

Signed and Sealed this
Tenth Day of May, 2016

Michelle K. Lee

Michelle K. Lee
*Director of the United States Patent and Trademark Office*